United States Patent [19]

Russell

[11] Patent Number: 4,491,187

[45] Date of Patent: Jan. 1, 1985

[54] SURFACE CONTROLLED AUXILIARY BLADE STABILIZER

[76] Inventor: Larry R. Russell, 6025 Edgemoor, Suite C, Houston, Tex. 77081

[21] Appl. No.: 508,814

[22] Filed: Jun. 29, 1983

Related U.S. Application Data

[63] Continuation-in-part of Ser. No. 383,481, Jun. 1, 1982, abandoned.

[51] Int. Cl.[3] ..... E21B 17/10

[52] U.S. Cl. ..... 175/325; 166/241; 308/4 A

[58] Field of Search ..... 175/325, 267, 269; 166/241, 212, 240; 308/4 A

[56] References Cited

U.S. PATENT DOCUMENTS

| | | | |
|---|---|---|---|
| 1,921,135 | 8/1933 | Santiago | 175/269 |
| 2,170,452 | 8/1939 | Grant | 175/269 |
| 2,427,052 | 9/1947 | Grant | 175/269 |
| 3,126,065 | 3/1964 | Chadderdon | 175/269 |
| 3,703,104 | 11/1972 | Tamplen | 166/240 |
| 4,081,042 | 3/1978 | Johnson et al. | 175/267 |

*Primary Examiner*—Stephen J. Novosad
*Assistant Examiner*—Thuy M. Bui
*Attorney, Agent, or Firm*—Carl B. Fox, Jr.

[57] ABSTRACT

Surface controlled blade stabilizer apparatus, for which surface control is achieved by alteration of internal drill string pressure to move a piston which carries an actuator for expanding the stabilizer blades, the blades being spring biased inwardly when not forced outwardly by the actuator. A barrel cam controls and guides the actuator to downward, upward and intermediate positions, so that the blades may be expanded, retracted, or held expanded when drill string pressure is reduced. The apparatus has a full open passage therethrough which is not interfered with by operation of the apparatus.

9 Claims, 12 Drawing Figures

Fig. 1E
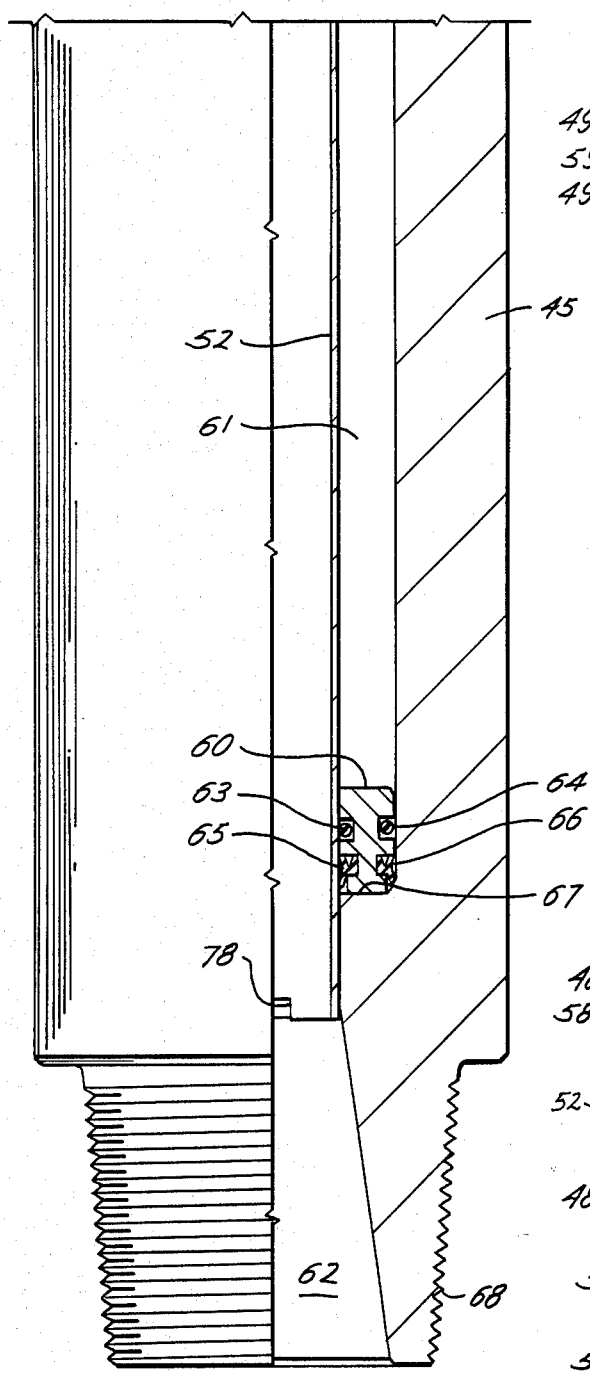
Fig. 2
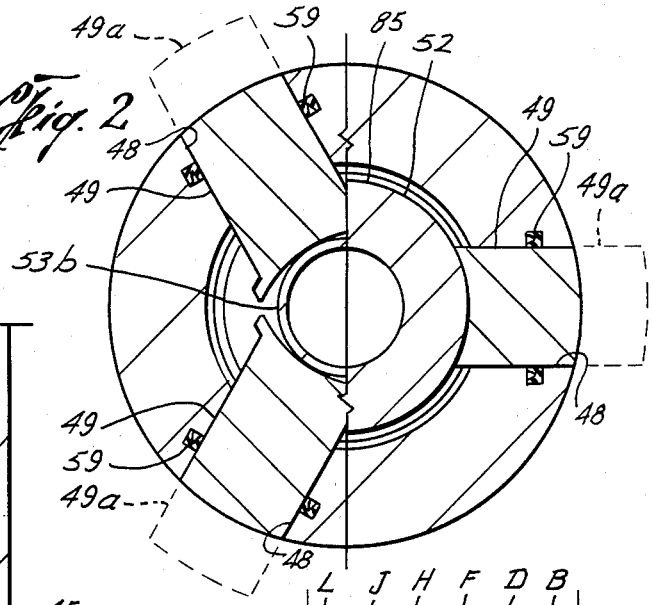
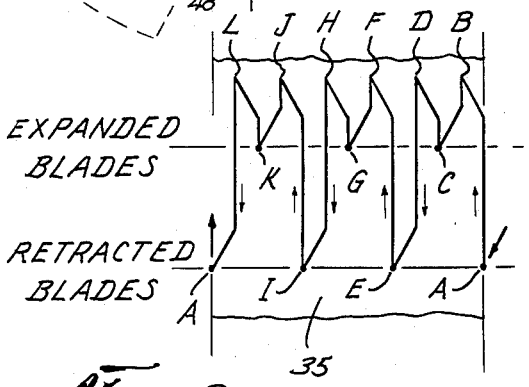
Fig. 3
Fig. 4
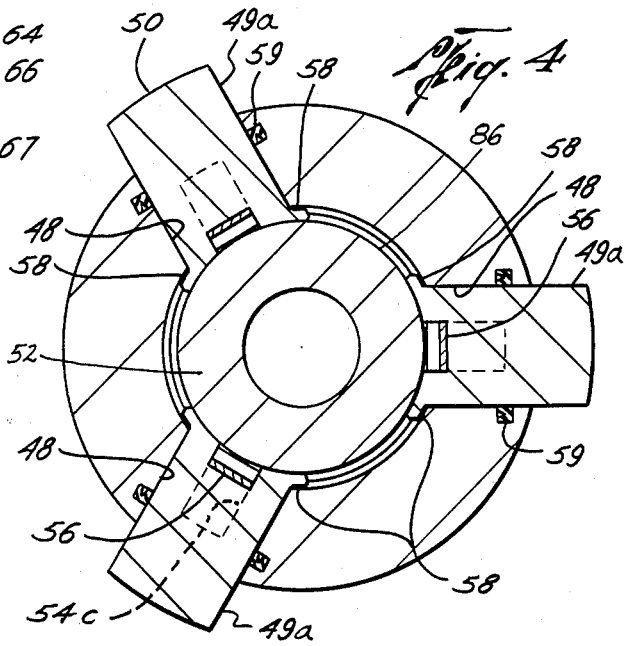

SURFACE CONTROLLED AUXILIARY BLADE STABILIZER

This application is a continuation-in-part of application Ser. No. 383,481, filed June 1, 1982, by the same applicant and having the same title, and now abandoned.

BACKGROUND OF THE DISCLOSURE

Most blade stabilizers used in the drilling of petroleum wells are of fixed design, not subject to being controlled from the surface of the well. Stabilizers are incorporated into the drill string, and serve to centralize the drill string in the well hole and to stabilize it against motions away from the well hole axis. The stabilizers are usually placed in the drill string at some depth well below the surface, it being necessary to withdraw the drill string from the well hole to install or relocate the stabilizers. This invention seeks to provide stabilizer apparatus which may be run into a well as part of the drill string and expanded and/or retracted at will to perform the stabilizer function as desired at a later time, and which may be repeatedly expanded and retracted as often as may be desired.

The surface controlled blade stabilizers afforded by this invention have a fully open flow passage therethrough, not restricted as is the case with the surface controlled blade stabilizers disclosed in application Ser. No. 368,996, filed Apr. 16, 1982, by the same applicant.

SUMMARY OF THE INVENTION

The stabilizers afforded by this invention have three or more radially movable stabilizer blades, which are disposed in slots of a lower body member of the apparatus. An expander mechanism interior of the blades is moved axially of the apparatus in one direction to cause expansion of the blades, and is moved in the opposite direction to permit retraction of the blades. The expander mechanism is controlled by control of fluid pressures interior of the apparatus, which may be controlled from the surface. Unlike the stabilizers disclosed in Application Ser. No. 368,996, filed Apr. 16, 1982, the stabilizer apparatus according to this invention has a full open flow passage therethrough, which is at no time closed or even partially closed. The apparatus may be operated by increased internal pressure to expand the stabilizer blades, and the internal apparatus pressure may be reduced while the blades are maintained in their outward positions. By variations of the fluid pressure within the apparatus, the stabilizer blades may also be retracted. These operations may be repeated as often as desired.

A principal object of the invention is to provide a drill string stabilizer apparatus which may be controlled from the surface. Another object of the invention is to provide such an apparatus having blades which may be expanded and retracted by alteration of internal drill string pressures. Another object of the invention is to provide such apparatus wherein control of the apparatus is achieved through changes in drill string pressure controlled entirely at the surface. Yet another object of the invention is to provide such apparatus wherein downward movement of an expander member causes stabilizer blade expansion, and upward movement of said member causes stabilizer blade retraction. A still further object of the invention is to provide such an apparatus having a full open fluid flow passage therethrough maintained fully open regardless of the expansion and retraction of the stabilizer blades. A further object of the invention is to provide such apparatus which is dependable, economical, and easily operated.

Other objects and advantages of the invention will appear from the following detailed description of a preferred embodiment, reference being made to the accompanying drawings.

BRIEF DESCRIPTION OF THE DRAWING

FIGS. 1A-1E are axial cross sectional views of a preferred form of apparatus according to the invention showing successive length portions of the apparatus from top to bottom.

FIG. 2 is a transverse horizontal cross section taken at line 2—2 of FIG. 1D.

FIG. 3 is a schematic diagram illustrating the form of a barrel cam employed in the preferred embodiment of apparatus according to the invention.

FIG. 4 is a transverse horizontal cross section taken at line 4—4 of FIG. 1D.

DESCRIPTION OF THE PREFERRED EMBODIMENT

Figure 1A:
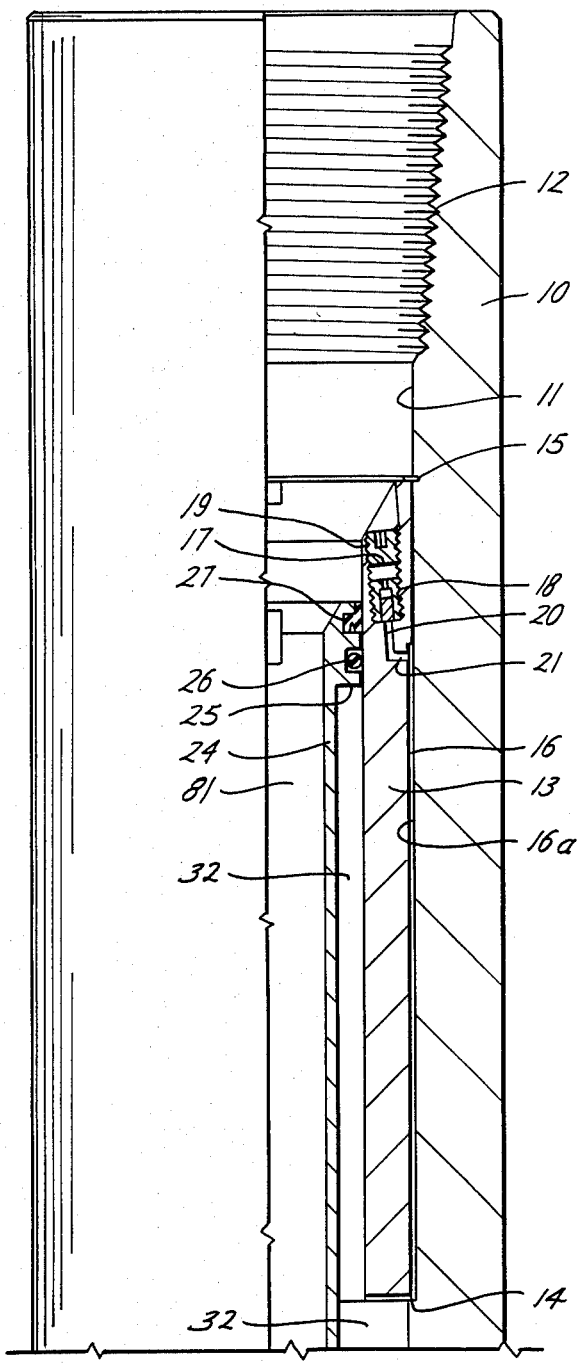

Referring now first to FIGS. 1A-1E of the drawings, the apparatus includes an upper tubular body member 10, of circular horizontal cross sections, having a bore 11 downwardly therethrough and having an internally threaded socket 12 at the upper end of bore 11 by means of which the apparatus may be connected to the lower end of an upper drill string portion. The upper drill string portion to which the apparatus is connected at socket 12 will usually extend to the surface, the internal drill string pressure may be controlled therein by suitable pumps or other facilities at the surface (not shown). The surface equipment for this purpose is conventional, and further explanation thereof is not necessary. An upper sleeve 13 is disposed within body member 10 between upwardly facing interior shoulder 14 thereof and a Spiralox snap ring 15. Sleeve 13 is outwardly relieved below its upper end at 16 to provide an annular space **16*a* therearound within body member 10. A port 17, enlarged at its upper end, houses a check valve 18 and a plug 19 both screwed into threads around the enlarged portion of port 17. The port 17 is reduced at its lower end 20 and turns outwardly at 21, to communicate with the space 16*a* formed by relief 16. Piston sleeve 24, spaced uniformly inwardly from sleeve 13, has upper outwardly projecting portion 25 around which an O-ring 26 and wiper ring 27 are disposed in suitable grooves. A lower accumulator end ring 28 having O-ring seal 29 in a groove therearound is screwed into bore 11 of body member 10 at threaded connection 30. O-ring seal 31 seals end ring 28 to the lower exterior of sleeve 24. The annular space above end member 28, between sleeve 24 and body member 10 and between sleeve 24 and sleeve 13, forms an annular accumulator space 32 into which a pressured fluid, such as nitrogen gas, is injected through check valve 18 when plug 19** has been removed, the accumulator charging being done while the apparatus is at the surface before it has been connected into the drill string.

Figure 1B:
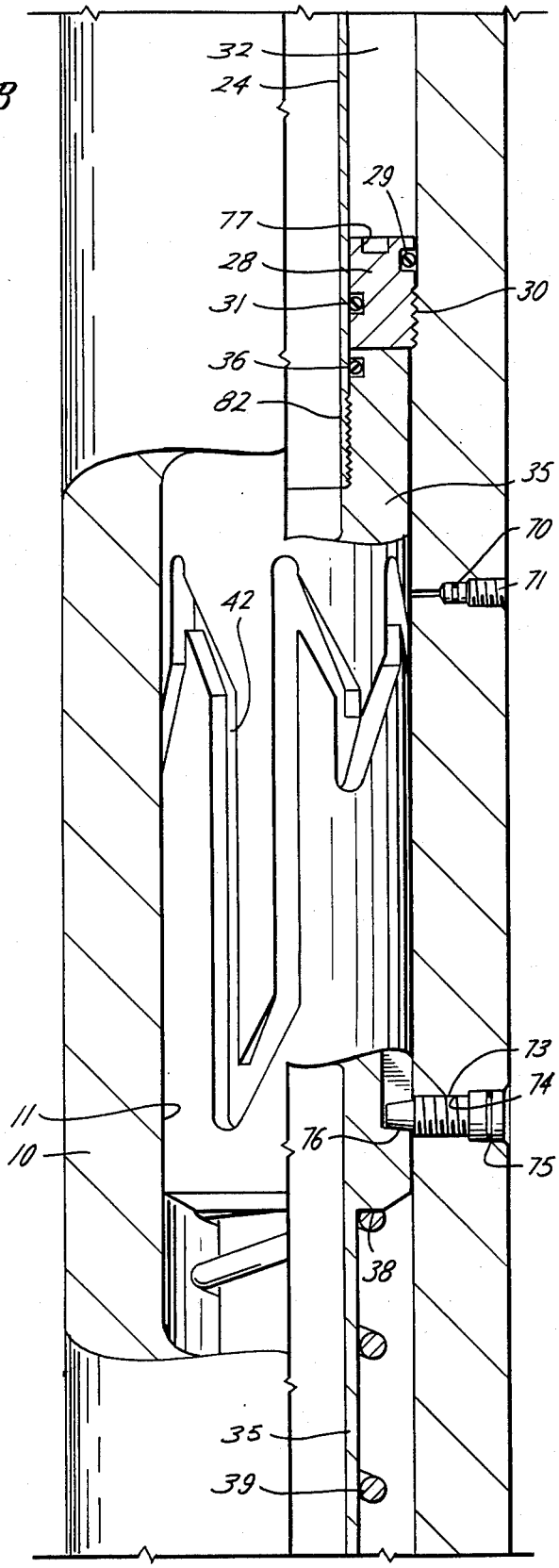
Figure 1C:
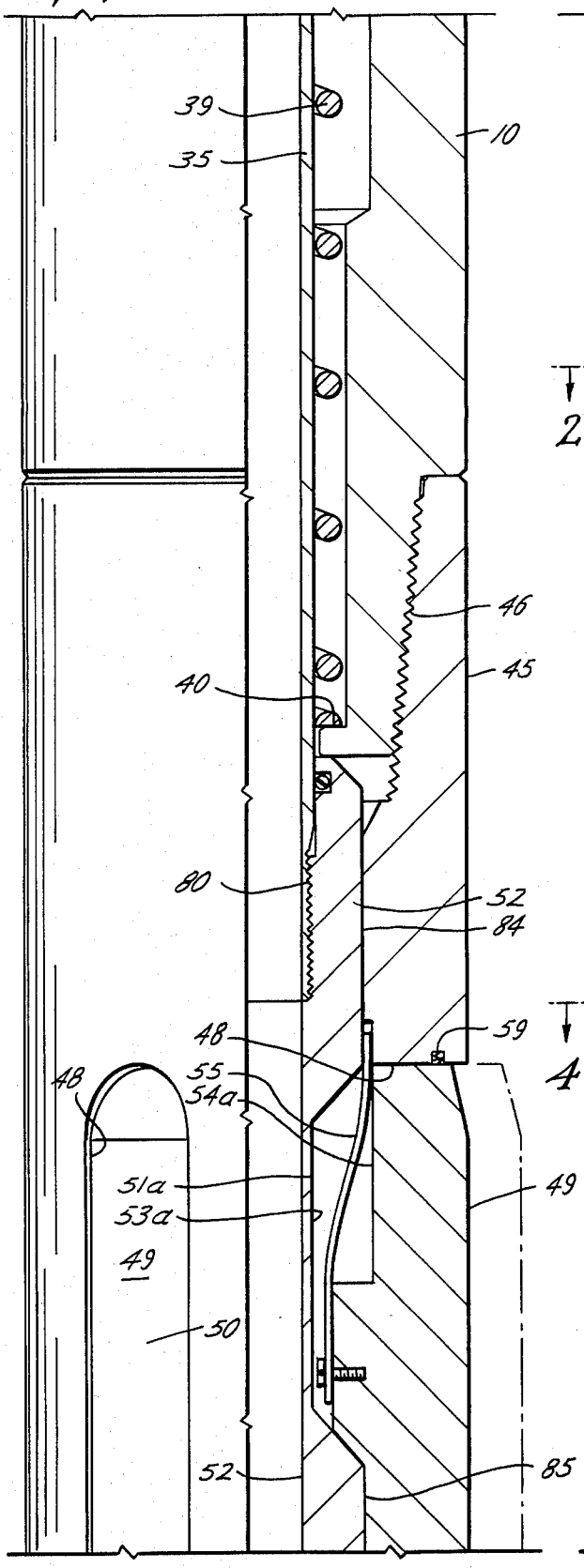
Figure 1D:
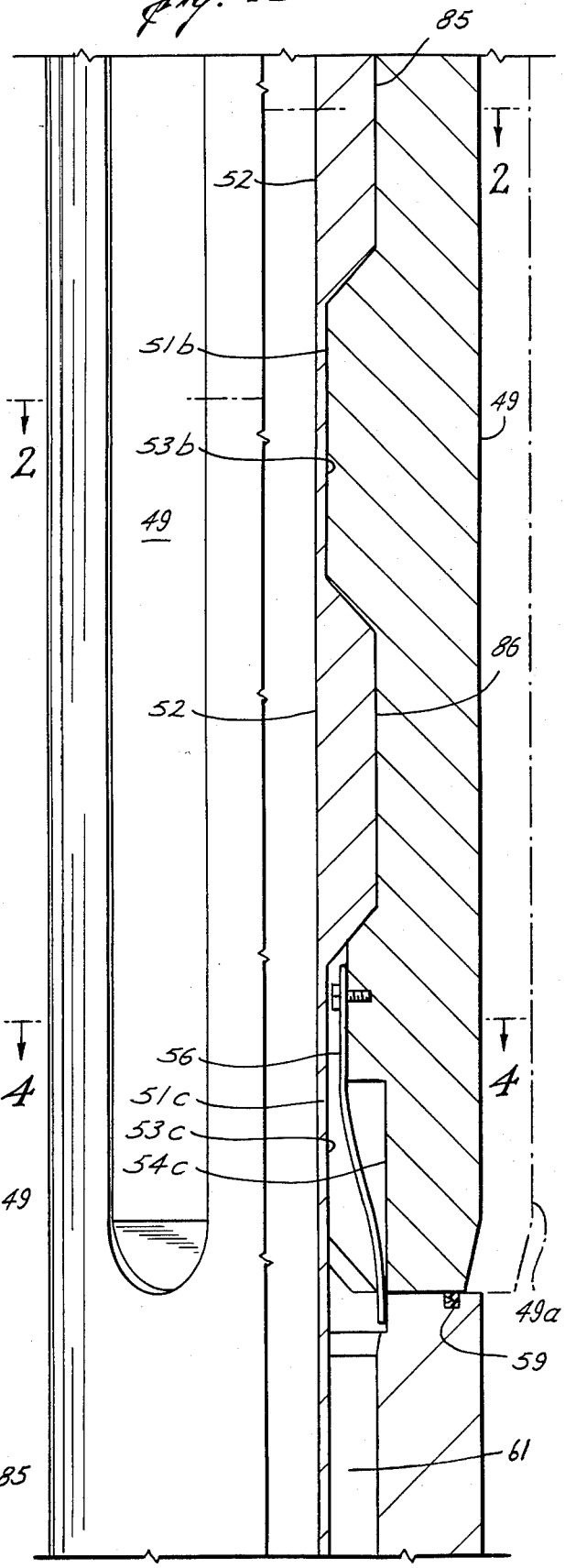
Figure 1F:
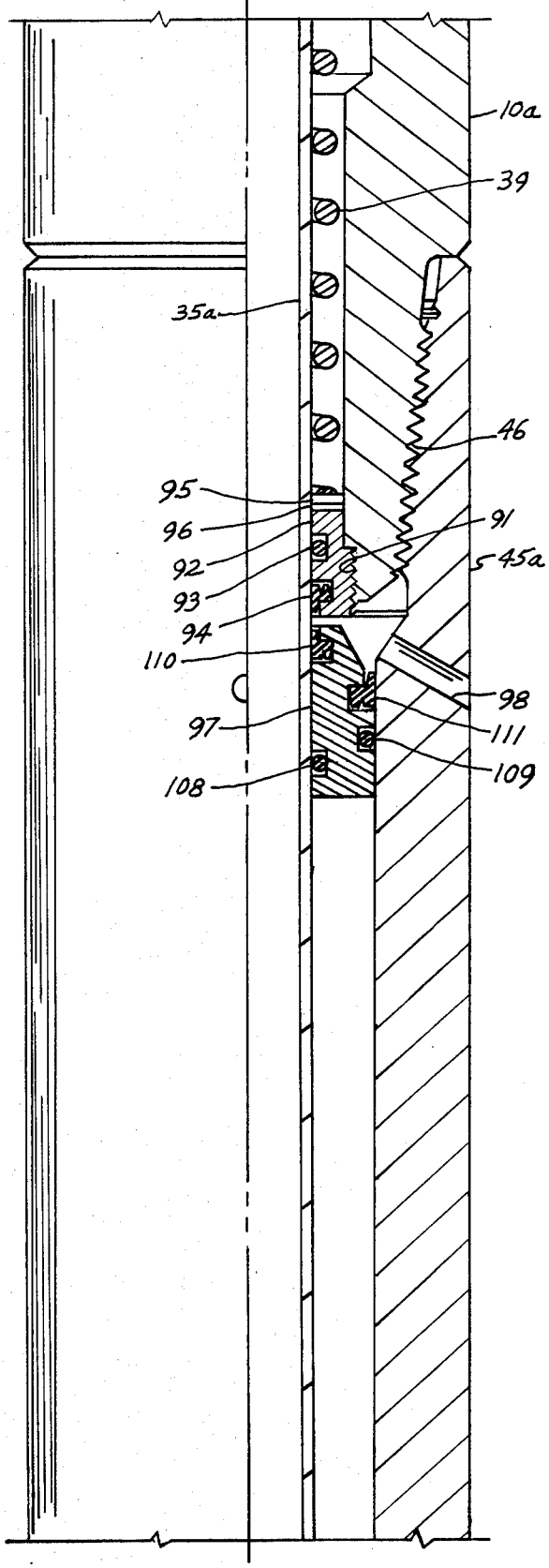
FIGS. 1F, 1G, 1H, and 1J are axial cross sectional views showing a modified form for the lower portion of the apparatus.
Figure 1G:
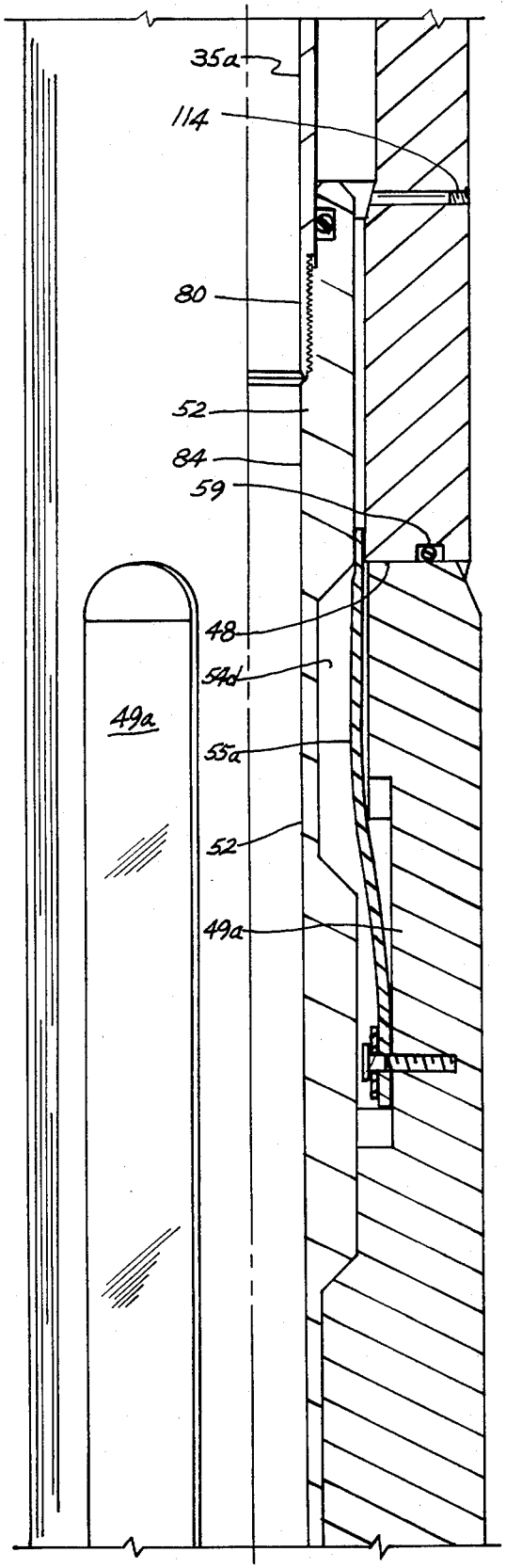
Figure 1H:
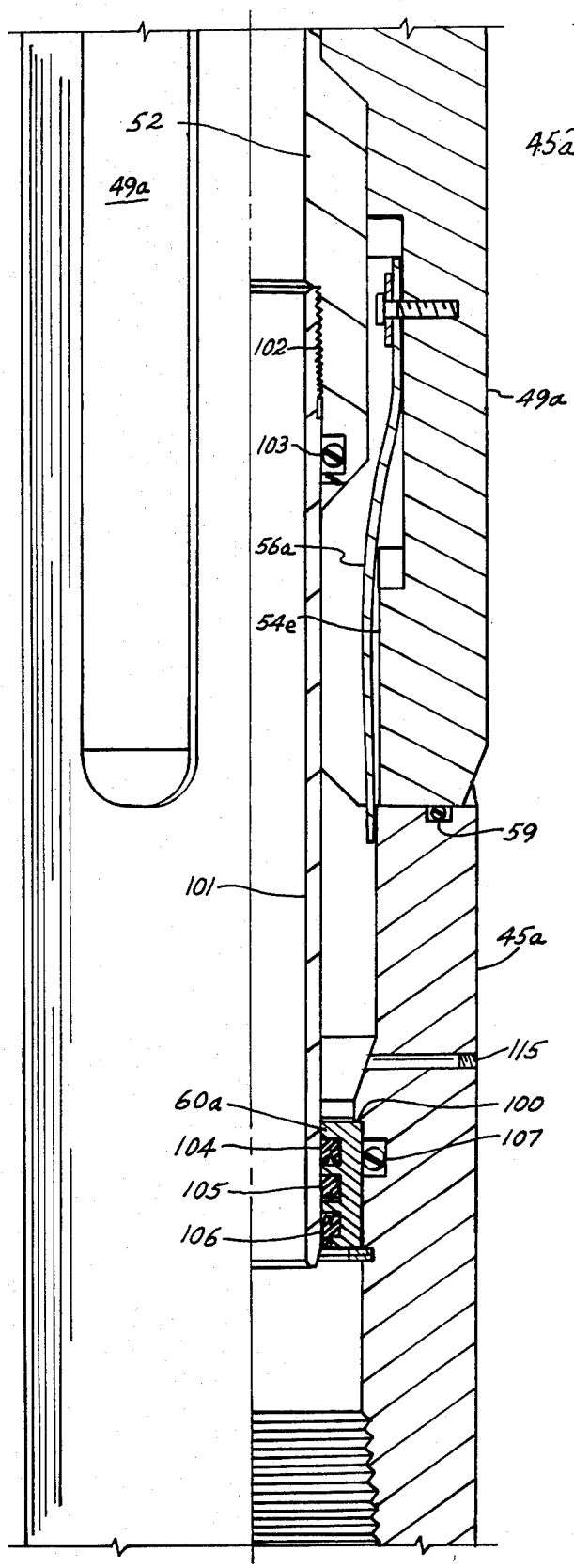
Figure 1J:
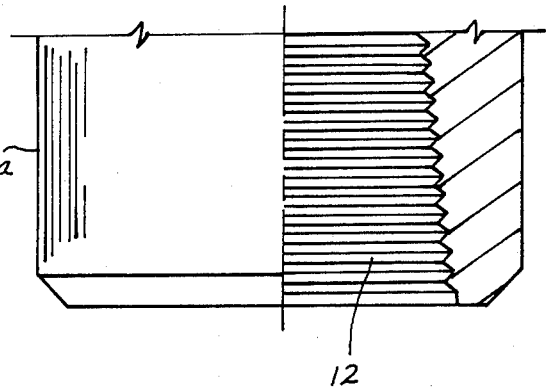

A tubular cam body 35 is disposed around the interior of body member 10 below accumulator end ring 28. An O-ring seal 36 seals between cam body 35 and the lower end of sleeve 24. Cam body 35 is of uniform wall thickness down to downwardly facing shoulder 38 and it is relieved outwardly therebelow to provide a space for a helical compression spring 39. Spring 39 bears/at its upper end against shoulder 38, and bears at its lower end against an upwardly facing shoulder 40 formed at the lower interior of upper body member 10. Spring 39, being under compression, biases cam element 35 upwardly. Cam body 35 has a barrel cam 42 machined around its outer surface, the form of the barrel cam being shown in FIG. 3 of the drawings. A lower body member 45 is connected at threaded connection 46 to the lower end of upper body member 10. Body member 45 has three vertical circularly spaced slots 48 through its wall, in each of which is disposed a stabilizer blade 49. Any suitable number of slots 48 and 49 may be provided, preferably three or more. Each stabilizer blade 49 is an elongate bar-like member having a smooth arcuate outer surface 50, as seen in FIG. 4, and having a shaped inner surface as seen in FIGS. 1C and 1D. The inner surfaces of the blades 49 have inwardly protruding formations 51*a*, 51*b*, 51*c*. Blade expander body 52 has correspondingly shaped recesses 53*a*, 53*b*, 53*c*, therearound. The protruding portions 51*a*–51*c* are received in the recesses 53*a*–53*c*, respectively. Protruding portions 51*a* and 51*c* are slotted at 54*a*, 54*c* to receive the leaf springs 55, 56, respectively. Stabilizer blades 49 each has flanges 58 along its opposite inner sides to prevent the stabilizer blades from moving out of the slots 48. A seal 59 surrounds the periphery of each stabilizer blade 49 to seal between the blade and the lower housing 45. The lower end of blade expander body 52 is thin walled and spaced uniformly inwardly from lower body member 45. A slidable balance piston 60 is disposed in the annular space between member 52 and lower body member 45 as shown in FIG. 1E. Piston 60 maintains a balance between the pressures in annular space 61 and the drill string bore space 62 therebelow. Inner and outer O-ring seals 63, 64 and wiper rings 65, 66 are provided in suitable interior and exterior grooves around piston 60. Piston 60 is stopped against further downward movement by an upwardly facing shoulder 67 formed at the lower interior of body member 45. At the lower end of body member 45, there is provided a threaded pin 68 for use in connecting the apparatus of the invention to a lower portion of the drill string. Referring to FIG. 1B, one or more oil injection ports 70 (one shown) each closeable by a screwed in plug 71 having a pair of O-ring seals therearound enables injection of lubricating oil around the cam body 35 and around blade actuator sleeve 52, for lubrication of the barrel cam 42 and the actuating body movements against the interior surfaces of the stabilizer blades. The annular space 61 is, therefore, filled with oil and the oil pressure is balanced by movement of piston 60 as before described. A camming pin 73 is screwed into a port 74 having internal threads, and an O-ring seal 75 provides a seal around the camming pin in port 74. The frustoconical tip 76 of the camming pin engages in barrel cam groove 42.

Accumulator end member 28 has a plurality of wrench slots 77 in its upper surface to enable it to be screwed into the threaded connection 30. Actuator body 52 has a plurality of wrench slots 78 in its lower end to enable body 52 to be screwed to cam body 35 at threaded connection 80. The bore 81 of piston sleeve 24 is usually two inches or greater in diameter so that a full flow passage through the apparatus is provided. The apparatus members below sleeve 24 have passages therethrough of at least the same size. Piston sleeve 24 is urged upwardly by the fluid pressure in accumulator space 32 and by compression spring 39 which acts upwardly on cam body 35 screwed to sleeve 24 at threaded connection 82. When the internal drill string fluid pressure is increased to a magnitude sufficiently high, piston sleeve 24 and cam body 35 connected therebelow, and actuating sleeve 52 are all moved downwardly because of the larger upper surface area of piston sleeve 24. The outwardly thicker areas 84–86 of the actuating sleeve 52 are forced at their end inclines onto the inwardly protruding areas 51*a*–51*c* of the stabilizer blades 49. The stabilizer blades are forced outwardly in slots 48 to the larger diameters shown in FIG. 4 and indicated by dashed lines 49*a* in FIG. 1D. The expanded blades perform their stabilizing and centralizing functions after piston sleeve 24 has been pushed downwardly, pushing cam body 35 and body 52 downwardly. Pin 73 moves in barrel cam groove 42 according to the barrel cam pattern.

The pin 73 remains stationary, and the cam body 35 is forced to rotate thereby. Referring to FIG. 3 of the drawings, if pin 73 is initially at point A of the barrel cam groove, downward movement of cam body 35 causes the pin to move in the groove to point B. Release of pressure within the drill string enables accumulator pressure and spring 39 to move the cam body 35 and sleeve 24 upwardly so that pin 73 moves to point C of the cam groove. Repeated increase of the internal drill string pressure moves pin 73 to point D of the cam groove. Another release of drill string pressure moves the pin to point E and successive increases and reductions of drill string pressure move pin 73 serially to points D through A of the barrel cam groove. When pin 73 is at points B, D, F, H, J, L, of the barrel cam groove, the stabilizer blades are expanded. When the camming pin is at points C, G, and K of the barrel cam groove, the stabilizer blades are maintained expanded while the drill string pressure is decreased and sleeve 24 is moved partway upwardly. When pin 73 is at points A, E, I or A of the barrel cam groove, the stabilizer blades are retracted by springs 55 and 56. While the shape of the barrel cam groove shown in FIG. 3 is satisfactory and may be preferred, other forms of barrel cam grooves may be used when determined to be suitable. It should be understood that the changes in drill string internal pressure may be satisfactorily controlled by operation of a surface pump, and pressuring and depressuring of the drill string interior may be done very rapidly, so that pin 73 may be moved through the full circuit of the barrel cam groove in a short period of time.

Referring now to FIGS. 1F, 1G, 1H and 1J of the drawings, there is shown therein a modified form of the lower portion of the apparatus, from the lower end of upper body member 10 to the lower end of the apparatus. Upper body member 10*a* has internal threads 91 into which a stationary seal ring 92 is screwed. Ring 92 has internal seals 93, 94 to seal it with cam element 35*a*. Washers 95, 96 are disposed upon the upper end of ring 92, and the lower end of spring 39 bears thereagainst.

Body member 45*a* is connected to upper body member 10*a* at threaded connection 46. Body member 45*a* is elongated between slots 48 and connection 46, and a movable seal ring 97 is slidably disposed between cam member 35*a* and the interior of body member 45*a*, as shown. A fluid port 98 is provided through body member 45*a* above seal ring 97. Upward movement of seal ring 97 is limited by engagement thereof with stationary seal ring 92, while both upward and downward movements thereof are caused and controlled by the volume displacement of the blades 49*a* moving inward and outward as has been described for the first disclosed form of the apparatus shown in FIGS. 1A–1E and 2–4. The blades 49*a*, usually three in number disposed in slots 48 circularly equally spaced around body member 45*a*, are moved outward by downward movement of cam body 52 and are moved inward by springs 55*a*, 56*a* after cam member 52 has been moved upward, as has already been described. Springs 55*a*, 56*a* are disposed in vertical slots 54*d*, 54*e* in the inner sides of the blades 49*a*.

Seal ring 60*a* is disposed against a downwardly facing shoulder 100 around the lower interior of body member 45*a* and seals with sleeve 101 connected to the lower end of cam member 52 at threaded connection 102. Seal 60*a* is not slidably movable as was seal 60 of the other embodiment, and is stationary.

As will by now be evident, the liquid volume displacements within the apparatus caused by inward and outward movements of the blades 49*a* are accompanied by respective upward and downward movements of slidably movable seal 97, seal 97 functioning as a piston. Fluid pressure within the apparatus is equalized with fluid pressure outside of the apparatus at piston 97, fluid entering or leaving the apparatus above piston 97 through flow port 98. Unless leaks occur at one or more of the seals 59, 103, 104–107, 108–111, a fixed volume of fluid is retained below piston 97 and above ring 60*a*, and between cam member 52, and sleeve 101 and body member 45*a* and blades 49*a*.

The apparatus, otherwise, operates in exactly the same manner as the first embodiment.

The ports through body member 45*a* which are closed by removable screwed in plugs 114, 115 are provided to enable introduction of a lubricant, such as oil, into the annular space behind blades 49*a*, so that the mutual sliding motions between blades 49*a* and cam member 52 will be of low friction.

It will further be understood that expansions and retractions of the stabilizer blades may be used in connection with directional drillng, in a manner known in the art. However, pulling and rerunning of the drill string to relocate positions of expanded stabilizer blades will not be necessary when the apparatus herein disclosed is used.

While a preferred embodiment of apparatus according to the invention has been described and shown in the drawings, many modifications thereof may be made by a person skilled in the art without departing from the spirit of the invention, and it is intended to protect by Letters Patent all forms of the invention falling within the scope of the following claims.

I claim:

1. Surface controlled stabilizer apparatus, comprising a tubular body adapted to be connected into a drill string in a well, a piston sleeve spaced uniformly inward of said tubular body and having an outwardly protruding portion around its upper end slidably and sealingly engaged with said tubular body, a tubular cam body connected to the lower end of said piston sleeve, a tubular blade expander body connected to the lower end of said cam body, an annular space between said piston sleeve and said tubular body comprising an accumulator space, means permitting injection of a pressured fluid into said accumulator space, the pressure within said accumulator space biasing said piston sleeve, and said cam body and blade expander body connected thereto, upwardly, compression spring means also biasing said piston sleeve, cam body and blade expander body upwardly, said piston sleeve being moved downwardly by elevated internal drill string pressure sufficient to overcome said accumulator pressure and spring bias to move said piston sleeve and said connected cam body and blade expander body downwardly, said tubular body having plural circularly spaced longitudinal slots therethrough outward of said blade expander body, a stabilizer blade slidably and sealedly disposed within each said slot to be moved radially outward when said blade expander body is moved downwardly and being spring biased to move radially inward when said blade expander body is moved fully upwardly, said cam body having barrel cam groove means therearound engaged by inwardly extending pin means carried by said tubular body, said barrel cam groove having a pattern around said cam body including pin positions wherein said blade expander sleeve is moved fully downward and said stabilizer blades are expanded by said blade expander body, and including pin positions wherein said blade expander sleeve is moved partway downward and said stabilizer blades are expanded by said blade expander body and including pin positions wherein said blade expander sleeve is moved fully upward and said stabilizer blades are retracted, whereby by successive alternate increases and decreases of said drill string internal pressure said stabilizer blades may be repeatedly expanded and retracted, and may be held expanded when internal drill string pressure is decreased when said pin is in a said barrel cam groove position wherein said blade expander sleeve is moved partway downward.

2. The combination of claim 1, including a sleeve lining said tubular body outward of said piston sleeve and wherein said outwardly protruding portion of said piston sleeve slides against said lining sleeve when said piston sleeve is moved downwardly and upwardly.

3. The combination of claim 2, said blade expander body having axially spaced outwardly protruding portions having frustonical ends and said blades having correspondingly shaped inwardly protruding portions adapted to engage closely between said outwardly protruding portions and adapted to be moved over said outwardly protruding portions when said blade expander body is moved downward.

4. The combination of claim 2, wherein said stabilizer blades have plural axially spaced inwardly protruding portions and said blade expander body has plural axially spaced outwardly protruding portions shaped to fit closely between said inwardly protruding portions of said blades when said blades are retracted, said inwardly protruding portions of said blades and said outwardly protruding portions of said blade expander body having upper and lower sloped ends to facilitate sliding movements therebetween, said outwardly protruding portions of said blade expander body being slid over said inwardly protruding portions of said blades to expand said blades when said blade expander body is moved downward relative said blades.

5. The combination of claim 4, the uppermost and lowermost of said inwardly protruding portions of said blades being axially slotted, said apparatus including spring means in said slots biasing said stabilizer blades inward to provide the aforesaid inward spring bias of said blades.

6. The combination of claim 5, said tubular body comprising an upper tubular body and a lower tubular body connected thereto at a threaded connection therebetween.

7. The combination of claim 6, said accumulator being precharged with pressured gas prior to connection thereof into said drill string.

8. The combination of claim 1, 2, 3, 4, 5, 6, or 7, said piston sleeve, said cam body, and said blade expander body having a continuous flow passage therethrough of substantially the same size as the flow passage of said drill string, whereby said apparatus does not hinder fluid flow through said drill string and does not interfere with movement of wireline and other tools through said drill string.

9. The combination of claim 1, 2, 3, 4, 5, 6, or 7, including an oil-filled annular lubricating space extending past said cam groove and said stabilizer blades to lubricate the same, said lubricating space having piston means for equalizing lubricant pressure with pressure within said drill string.

* * * * *